US005878719A

United States Patent [19]

Nakagomi

[11] Patent Number: 5,878,719

[45] Date of Patent: Mar. 9, 1999

[54] INJECTOR MOUNTING STRUCTURE FOR ENGINES

[75] Inventor: Akira Nakagomi, Fujisawa, Japan

[73] Assignee: Isuzu Motors Limited, Tokyo, Japan

[21] Appl. No.: 965,201

[22] Filed: Nov. 6, 1997

[30] Foreign Application Priority Data

Nov. 15, 1996 [JP] Japan ..... 8-318494

[51] Int. Cl.[6] ..... F02M 33/04

[52] U.S. Cl. ..... 123/470

[58] Field of Search ..... 123/468, 469, 123/470

[56] References Cited

U.S. PATENT DOCUMENTS

| | | | |
|---|---|---|---|
| 2,898,895 | 4/1959 | Koppel et al. | 123/470 |
| 3,194,221 | 7/1965 | Dinger et al. | 123/469 |
| 5,617,828 | 4/1997 | Kuegel et al. | 123/470 |
| 5,697,344 | 12/1997 | Ikari | 123/468 |
| 5,699,770 | 12/1997 | Matsumoto et al. | 123/470 |
| 5,775,303 | 7/1998 | Sweetland et al. | 123/470 |

FOREIGN PATENT DOCUMENTS

| | | |
|---|---|---|
| 0775820 | 5/1997 | European Pat. Off. . |
| 2059793 | 6/1971 | Germany . |
| 4205263 | 8/1993 | Germany . |
| 8-26114 | 10/1996 | Japan . |

OTHER PUBLICATIONS

Japan Abstract 07317633, H. Shigeaki, "Oil seal device for injection nozzle holder", vol. 096, No. 004, Dec. 12, 1995.

*Primary Examiner*—Thomas N. Moulis
*Attorney, Agent, or Firm*—Browdy and Neimark

[57] ABSTRACT

This injector mounting structure has attained the reduction of the length of a fuel pipe, a total height of an engine and a distance between cam shafts. A fuel supply boss extends from the relative injector diagonally at a predetermined angle, and passes a position close to the cam shafts and then a position between cams mounted on these cam shafts, so that it becomes possible to minimize the total height of an injector body, and reduce the length of the fuel pipe to be connected to a fuel supply boss. The fuel supply boss is provided with an escape portion for preventing the fuel supply boss and cam shafts from interfering with each other, whereby the fuel supply boss and cam shafts may be disposed closer to each other. The distance between the cam shafts becomes shorter, and the shafts of the suction and exhaust valves can be disposed closer to each other as they are kept parallel to each other, the performance of even a miniaturized engine being not deteriorated.

4 Claims, 2 Drawing Sheets

INJECTOR MOUNTING STRUCTURE FOR ENGINES

BACKGROUND OF THE INVENTION

1. Field of the Invention

This invention relates to an injector mounting structure for mounting injectors on a cylinder head of an engine, especially, a direct injection engine.

2. Description of the Invention

It has been demanded in recent years that, mainly, a miniaturized diesel engine is formed to a DOHC and multi-valve structure having two cam shafts per cylinder and two suction valves or exhaust valves per cam shaft so that such a diesel engine meets the necessary conditions of having a high output, a low fuel consumption and a capability of following the exhaust gas regulations. There is a known engine of this kind (Japanese Patent Laid-Open No. 261114/1996) in which injectors, the number of which corresponds to that of cylinders, are provided in a cylinder head so as to extend to substantially central portions of the cylinders, two cam shafts extending in parallel with each other so as to sandwich the injectors being provided in the cylinder head, the injectors being provided between two cams for suction valves or two cams for exhaust valves which are mounted on their respective cam shafts.

Each of the injectors disclosed in the above-mentioned publication is provided in a vertically extending state between two cam shafts. An upper end portion of the injector projects to a position above a cylinder head cover, and a fuel supply pipe and a fuel return pipe are connected to this projecting upper end portion. Since the injectors are of a vertically extending type, a total height of the engine becomes large, so that the engine requires a large space. When the total height of the engine is large, a space necessary for disposing fuel pipes connected to the injectors also becomes large.

In a structure in which injectors are projected from a head cover with joint portions for fuel pipes, such as fuel supply pipes and fuel return pipes provided at the upper ends thereof, it is necessary that the portions of the fuel supply pipes which are in the vicinity of the joint portions of the injectors be bent so as to prevent the fuel supply pipes from interfering with other constituent parts. However, there is a limit to a bend radius of the high-pressure fuel supply pipes, so that the high-pressure fuel pipes have to be gently bent. To meet the requirements, it is necessary that a sufficient spatial margin be provided between the fuel pipes and other constituent parts. When a fuel injection pump is fixed to a side portion of an engine, the length of the fuel supply pipes connecting the fuel injection pump and the joint portions mentioned above together becomes large.

Since the long fuel pipes have a high passage resistance of a fuel passing therethrough, a response delay of fuel injection is liable to occur, and the engine performance and exhaust gas characteristics would be deteriorated.

In a miniaturized direct injection diesel engine having small cylinder bore diameter, valve stems are necessarily formed so that the valve stems are positioned close to and incliningly with respect to injectors unless it is possible that the positions of the ports of suction and exhaust valves with respect to combustion chambers are set close to each other as these ports are kept perpendicular to a port-opened wall surface, in other words, unless it is possible that cam shafts on which valve driving cams are mounted are provided close to each other as the cam shafts are kept parallel to the injectors. In such a structure, the valve ports are opened diagonally with respect to the combustion chambers, and, when the angle of inclination of the valve ports is large, the engine performance is deteriorated as a natural consequence. It is conceivable that the joint portions between the injectors and fuel pipes are provided simply on one side of the injectors so as to solve the above-mentioned problems which arise when the joint portions of the fuel pipes with respect to the injectors are provided on the upper ends of the injectors. However, when the joint portions of the injectors, which are provided between parallel cam shafts positioned above the cylinder head, and also between the cams for the suction and exhaust valves mounted on these cam shafts, with respect to the fuel pipes are simply provided on one side of the injectors, the cam shafts and fuel passage bosses interfere with each other. When any measures are taken in order to prevent this interference, another problem that a distance between the cam shafts increases instead occurs.

Since a distance between the valve ports of the suction and exhaust valves is fixedly set in accordance with the type of the engine, the valve stems incline, when a distance between the cam shafts increases, with respect to the axis of the injector. In such a structure of the valve ports opened in a combustion chamber, an excellent engine performance cannot be expected. Therefore, it is desired that consideration be given to the correlation in the injector mounting structure between the fuel passage in the injector and an arrangement for preventing the interference of the fuel passage boss and cam shafts with each other, so as not to cause the deterioration of the performance of a miniaturized diesel engine as well.

SUMMARY OF THE INVENTION

An object of the present invention is to provide an injector mounting structure for, especially, a miniaturized direct injection engine, capable of solving the spatial and piping problems and preventing the deterioration of the performance of the engine owing to the parallel arrangement of valve stems by forming a fuel passage boss, which has a passage for introducing a fuel into the injector and discharging the same therefrom, so as to extend incliningly with respect to an injector body, and disposing the fuel passage boss so as to prevent the same from interfering with cams and cam shafts, on which the cams are mounted, used to drive the suction and exhaust valves.

The present invention relates to an injector mounting structure for engines, comprising injector bodies mounted on a cylinder head and provided respectively with a first fuel passage and fuel injection port, a fuel passage boss provided in each of the injector bodies and hiving a second fuel passage communicating with the first fuel passage, the injector bodies being provided between cam shafts, which are parallel-arranged above the cylinder head, and between valve operating cams mounted on the cam shafts, the fuel passage boss extending from each of the injector bodies and passing through a position above one cam shaft and between the valve operating cams so as to make a predetermined angle to the axis of each of the injector bodies, joint portions of the first and second fuel passages being connected together at a predetermined obtuse angle.

The fuel passage boss extends from each of the injector bodies and passing through a position above one of the parallel-arranged cam shafts and between the cams so as to make a predetermined angle to the axis of the injector body. Accordingly, the fuel passage boss is positioned close to the cam shafts, and the joint portions of the fuel passage boss and injector body are necessarily disposed in a lower position, so that it becomes possible to place an upper structure of the injector in a lower position, and minimize a total height of the engine.

The stems of the suction and exhaust valves become able to be disposed closer to each other as these shafts maintain their parallel posture with respect to the injector, i.e. their vertical posture with respect to the combustion chamber, and the performance of even a miniaturized diesel engine is not deteriorated.

Since the first and second fuel passages are joined together at a predetermined obtuse angle, the joint portions of the fuel passage boss and injector body can be set in a lower position, and a total height of the engine can be reduced correspondingly.

A profile of the valve operating cam comprises a basic circular surface and a cam surface, and the joint portions of the first and second fuel passages is positioned lower than a horizontal plane contacting the uppermost end of the basic circular surface of the valve operating cam. When the joint portions of the first and second fuel passages are set in such a position, the portion of the injector which is above these joint portions can be positioned closer to an upper surface of the cylinder head. Therefore, the total height of the injector, i.e. the total height of the engine can be reduced to a limit level at which the interference of the fuel passage boss and cam shafts with each other can be prevented.

The section of the fuel passage boss which is adjacent to a cam shaft is formed with an escape portion for preventing the boss from interfering with the cam shaft. In such an injector mounting structure, the height of the fuel passage boss measured from the upper surface of the cylinder head further decreases to cause the total height of the engine to further decrease. It also becomes possible that the shafts of the suction and exhaust valves operated by the valve operating cams be set closer to the injector with these shafts kept parallel to the axis of the injector.

The second fuel passage formed in the fuel passage boss is a fuel supply passage for supplying a fuel to be injected from the injection port. It is conceivable that the second fuel passage formed in the fuel passage boss provided on the injector comprises a fuel supply passage and a fuel return passage. The fuel supplied through a fuel supply passage is generally a high-pressure fuel. Therefore, when a fuel supply boss is disposed close to a cam shaft so as to extend at a predetermined angle to the axis of the relative injector body, the length of a fuel pipe, which extends from a fuel pump and is connected to the fuel supply boss, can be reduced, and the saving of a space can be attained.

DETAILED DESCRIPTION OF THE EMBODIMENT

An embodiment of the injector mounting structure for engines according to the present invention will now be described with reference to the attached drawings.

Figure 1:
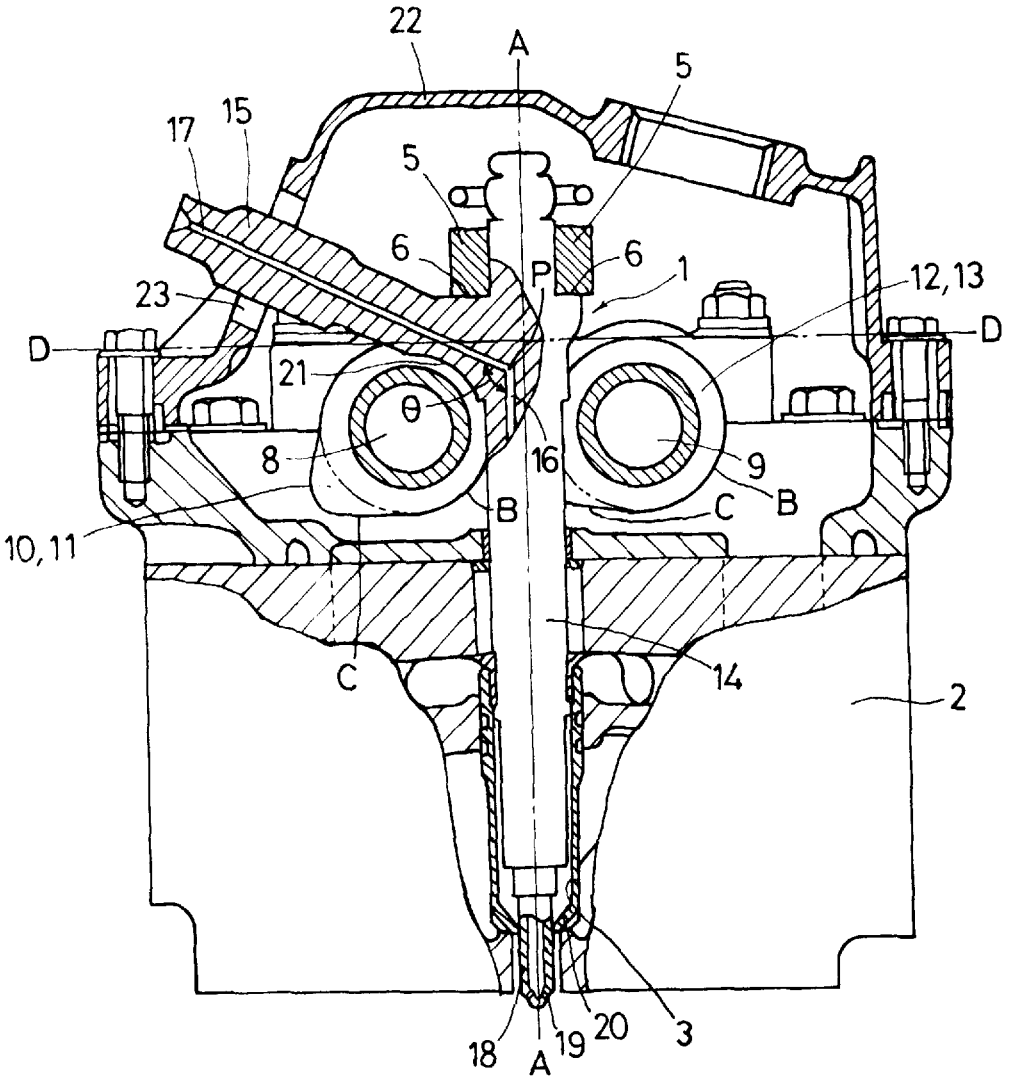
FIG. 1 is a sectional view showing an embodiment of the injector mounting structure for engines according to the present invention.
Figure 2:
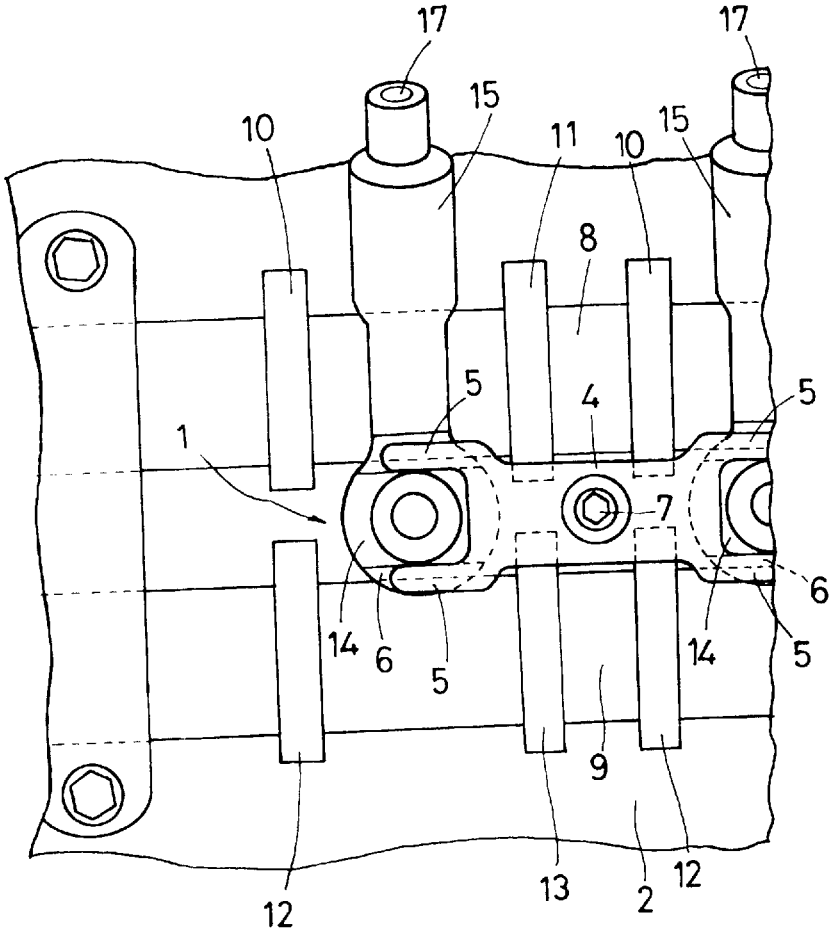
FIG. 2 is a schematic top view showing the injector mounting structure for engines of FIG. 1 with a cylinder head cover removed.

A miniaturized multicylinder diesel engine has a plurality of series-arranged injectors 1 but, to simplify a description thereof, a part of a cylinder head 2 of the miniaturized multicylinder diesel engine is shown with respect to one injector 1 only in FIGS. 1 and 2.

The injector 1 is fitted in a mounting bore 3 formed in the cylinder head 2, and fixed thereto by a clamp member 4. The clamp member 4 is formed out of an elastic metal material. The shape in plan of the clamp member 4 is generally that of an elongated plate, both end portion of which has the same structure so that the clamp member 4 is used for both this injector and an adjacent injector. As shown in FIG. 2, a contact portion of the clamp member 4 with respect to the injector 1 is formed as a forked portion 5 for holding the injector between two blades thereof. The forked portion 5 is engaged with shoulder portions 6 constituting clamping pressure receiving surfaces of both side sections of an upper portion of the injector 1. The shoulder portions 6 are formed by cutting off the portions of an unnecessary thickness of the injector, and making flat surfaces on the cutoff portions. An intermediate portion of the clamp member 4 is fixed to the cylinder head 2 by a setting bolt 7, whereby the injector 1 is fixed to the cylinder head 2. A lower end portion of the injector 1 is pressed against a tapering surface of the mounting bore 3 via a nozzle packing 20 by a clamping force of the clamp member 4. A clearance between a combustion chamber and the mounting bore 3 is sealed by the nozzle packing 20.

The clamp member 4 can be used in common not only with an adjacent injector 1 but also with not less than three injectors 1. In the latter case, the clamp member is provided with a central hole, through which an intermediate injector 1 is to be passed, in addition to both side holes for both side injectors 1, and a pressing portion at which the clamp member is pressed against the pressure receiving surfaces of the relative injector is formed around this central through hole.

Above the cylinder head 2, two parallel-extending cam shafts 8, 9 are held rotatably. The cam shaft 8 is provided on the portions thereof which are on both sides of the injector 1 with two cams 10, 11 for driving suction and exhaust valves. The cam shaft 9 is also provided at the portions thereof which are on both sides of the injector 1 with two cams 12, 13. Accordingly, four suction and exhaust valves are opposed to the injector 1. The injector 1 is positioned in the center of the four suction and exhaust valves surrounding the same. A profile of each of the cams 10, 11 and 12, 13 comprises a basic circular surface B, and a cam surface C formed so as to project from the basic circular surface B. A distance between the cam shafts 8, 9 is not more than two times as large as that between the axes of the cam shafts 8, 9 and the apexes of the cam surfaces C of the cams 10, 11 and 12, 13. However, the instants at which the suction and exhaust valves are operated are different between the cams 10, 11 and cams 12, 13, and the cam shafts 8, 9 are rotated with a predetermined rotation angle relation maintained therebetween. Therefore, the cams 10, 11 and cams 12, 13 do not interfere with each other during the rotation of the cam shafts 8, 9.

The injector 1 comprises an injector body 14, and a fuel injection boss 15 integral with the injector body and extending from an upper portion thereof at a predetermined angle to the axis A—A thereof. The injector body 14 is provided therein with a fuel supply passage 16 extending in parallel with the axis A—A thereof, and the fuel supply passage 16 and a fuel supply passage 17 in the fuel supply boss 15 are joined to each other at a connection point P so as to make a predetermined obtuse angle shown by θ. The fuel supply passages 16, 17 constitute first and second fuel passages in the injector 1. A fuel pipe (not shown) is connected to the fuel supply boss 15 via a suitable joint, and a high-pressure fuel is supplied from a fuel pump provided on the outer side of the engine to the injector 1 through the fuel pipe. When the pressure of the fuel supplied to the injector 1 has reached a predetermined level, the fuel is injected from the fuel supply passage 17 into a combustion chamber via the fuel supply passage 16 and an injection port 19 of a nozzle 18 formed at a lower end of the injector body 14.

The fuel supply boss 15 is disposed above the cam shaft 8 and between the cams 10, 11, and extends diagonally upward so as to cross the cam shaft 8. The fuel boss 15 is provided as close as possible to the cam shaft 8 so as to narrow a clearance between itself and the cam shaft 8. Accordingly, the position of installation of the fuel supply boss 15 is low and close to an upper surface of the cylinder head, and the connecting of the fuel pipe to the injector 1 can be done not at an upper end of the injector 1 but at a side portion thereof. When the clearance between the cam shaft 8 and fuel supply boss 15 is narrowed, it becomes possible that the cam shafts 8, 9 be disposed close to each other. When the cam shafts 8, 9 are disposed close to each other, the suction and exhaust valves driven thereby can be disposed close to each other with the suction and exhaust valves kept parallel to the injector 1, in other words, with these valves kept vertical with respect to the combustion chamber. Therefore, the lowering of the performance of even a miniaturized diesel engine having small combustion chambers does not occur.

Since the fuel supply passages 16, 17 are connected together at the connection point P so that they make a predetermined obtuse angle θ, the connection point P is offset to the side of the injection ports of the injector body 14. Namely, the connection point P is set in a position lower than a plane D—D contacting the uppermost ends of the basic circular surfaces B constituting the profiles of the cams 10, 11; 12, 13, i.e., this point P is offset to the side of the injection ports 19. Consequently, the portion of the injector 1 which is higher than the connection point P lowers, so that a total height of the injector 1 can be reduced to a limit level at which the fuel passage boss 15 and the cam shafts 8, 9 do not interfere with each other. As a result, a total height of the engine can be reduced.

If the strength of the fuel supply boss 15 permits, an escape portion 21 in the form of an arcuately recessed surface constituting a part of the circumference of a cylinder may be formed in the portion of the fuel supply boss 15 which is adjacent to the cam shaft 8, so as to prevent the fuel supply boss 15 and cam shaft 8 from interfering with each other, whereby the fuel supply boss 15 can be disposed closer to the cam shaft 8.

The upper surface of the cylinder head 2 including the injector 1, cam shafts 8, 9 and cams 10, 11 and 12, 13 is generally covered with the head cover 22. A hole 23 formed in the cylinder head cover 22 corresponds to the fuel supply boss 15, and an upper end portion of the fuel supply boss 15 projects out of the cylinder head cover 22.

An embodiment of the injector mounting structure for engines according to the present invention has been described above as an injector mounting structure for a miniaturized diesel engine. It is clear that this embodiment can also be applied to various engines as long as they are injector type engines, such as diesel engines having various types of injection systems, and cylinder injection type gasoline engines.

The injector mounting structure according to the present invention formed as described above has the following effects. Since the fuel pipe is connected to the fuel passage boss and not to the upper end of the injector, the total height of the engine can be set lower, and the fuel pipe can be connected at a side portion of the cylinder head cover, whereby the length of the fuel pipe can be reduced. Consequently, the problems concerning the piping around the engine including the space saving requirement and an injection response delay are solved. Even in a multi-valve type engine in which cam shafts are parallel-arranged on the cylinder head, the stems of the suction and exhaust valves driven by cams mounted on the cam shafts can be disposed close to each other as the suction and exhaust valves are kept parallel to the injector, in other words, as the suction and exhaust valves are kept vertical with respect to the combustion chamber. This enables an engine to meet the miniaturization requirement without causing the performance thereof to lower.

What is claimed is:

1. An injector mounting structure for engines, comprising injector bodies mounted on a cylinder head, each of said injector bodies being provided with a first fuel passage and a fuel injection port, each of said injector bodies being provided with a fuel passage boss having a second fuel passage communicating with said first fuel passage, each of said injector bodies being disposed between cam shafts positioned in parallel with each other above said cylinder head, and between valve operating cams mounted on said cam shafts, said fuel passage boss extending from each of said injector bodies and passing through a position above one of said cam shafts and between said valve operating cams so as to make a predetermined angle to the axis of the relative injector body, joint portions of said first and second fuel passages being connected together at a predetermined obtuse angle.

2. An injector mounting structure for engines according to claim 1, wherein profiles of said valve operating cams comprise basic circular surfaces and cam surfaces, said joint portions of said first and second fuel passages being positioned lower than a horizontal plane contacting the uppermost ends of said basic circular surfaces of said valve operating cams.

3. An injector mounting structure for engines according to claim 1, wherein the section of said fuel supply passage boss which is adjacent to said cam shafts being provided with an escape portion for preventing said fuel passage boss and said cam shafts from interfering with each other.

4. An injector mounting structure for engines according to claim 1, wherein said second fuel passage formed in said fuel passage boss constitutes a fuel supply passage for supplying said fuel to be injected from said injection port.

* * * * *